US005193418A

United States Patent [19]

Behrenfeld

[11] Patent Number: 5,193,418

[45] Date of Patent: Mar. 16, 1993

[54] DRUM KEY

[76] Inventor: Eric J. Behrenfeld, 2450 N. Francisco, Chicago, Ill. 60647

[21] Appl. No.: 885,526

[22] Filed: May 19, 1992

Related U.S. Application Data

[63] Continuation-in-part of Ser. No. 514,699, Apr. 26, 1990.

[51] Int. Cl.[5] ..... B25B 13/06

[52] U.S. Cl. ..... 81/121.1; 81/487; 81/180.1

[58] Field of Search ..... 81/3.15, 57.4, 121.1, 81/177.1, 180.1, 462, 487, 489; 269/254 R; 411/402

[56] References Cited

U.S. PATENT DOCUMENTS

| | | | |
|---|---|---|---|
| 94,766 | 9/1869 | Patton et al. . | |
| 504,887 | 12/1893 | Moore | 411/402 |
| 672,125 | 4/1901 | Heidt | 81/487 |
| 1,200,158 | 10/1916 | Barrett | 81/487 |
| 1,925,393 | 9/1933 | Lehman . | |
| 2,735,321 | 2/1956 | Browne et al. | 81/121.1 |
| 3,916,736 | 11/1975 | Clemens . | |
| 4,208,942 | 6/1980 | Henrit | 81/121.1 |
| 4,620,460 | 11/1986 | Gonzales, Jr. . | |
| 4,967,614 | 11/1990 | Van Horssen | 81/176.15 |

FOREIGN PATENT DOCUMENTS

| | | |
|---|---|---|
| 0919872 | 11/1954 | Fed. Rep. of Germany . |
| 0393775 | 1/1909 | France . |
| 0007896 | of 1890 | United Kingdom . |

OTHER PUBLICATIONS

Belières, Par La Société Spindler FIGS. 4–9, 13, 14 77346 Jul. 29, 1867.

Sanderson's Specification, Jun. 25, 1762, No. 777.

Wood & Gemmel's, Mar. 27, 1888, No. 4666.

*Primary Examiner*—J. J. Swann

*Attorney, Agent, or Firm*—Speckman & Pauley

[57] ABSTRACT

A drum key having an elongated drum key shaft. The drum key shaft has a non-circular bore at an open end. A longitudinal bore axis of the non-circular bore is preferably aligned with a centerline axis of the drum key shaft. A torquing wing is integrally formed with the drum key shaft. A pair of elongated arcuate prongs are integrally formed with and extend outward from a neck which extends from an upper wing surface of the torquing wing. Prong tips of the arcuate prongs are spaced apart from each other. The arcuate prongs have inner arcuate surfaces which face or oppose each other. To prevent fracture or failure when the arcuate prongs are spread apart, stops extend from the upper wing surface and are positioned at a fixed distance designed to limit deflection of the arcuate prongs.

12 Claims, 4 Drawing Sheets

DRUM KEY

CROSS-REFERENCE TO RELATED APPLICATION

This is a continuation-in part patent application of my co-pending patent application having Ser. No. 07/514,699, filed Apr. 26, 1990.

BACKGROUND OF THE INVENTION

1. Field of the Invention

This invention relates to a drum key having a drum key shaft with a non-circular bore, a wing for torquing the drum key shaft, and a pair of elongated arcuate prongs integrally formed with a neck extending from the wing for attaching the drum key to a tubular structural member of the drum equipment.

2. Description of the Prior Art

Existing drum key wrenches have a wrench shaft with an open end for accommodating a tension rod or nut. Such existing drum key wrenches also have wings for torquing the wrench shaft.

One known drum key wrench has a through hole in one extended wing so that a key chain, wire or the like can be inserted into the through hole. Another known key wrench has a through hole in the wrench shaft for accommodating a key chain, wire or the like. Such known key wrenches cannot be easily and conveniently stored during non-use. Thus, there exists a need for a drum key which can be quickly attached to and detached from a tubular structural member, such as a drum stand support member.

SUMMARY OF THE INVENTION

It is one object of this invention to provide a drum key that can be clipped or attached to a tubular structural member.

It is another object of this invention to provide a drum key that has two extending arcuate prongs for clipping or attaching the key wrench to the tubular support member.

It is yet another object of this invention to provide a drum key which can be injection molded into one piece with a high-strength polymeric material.

The above and other objects of this invention are accomplished with a drum key that includes a drum key shaft having a bore with a non-circular cross section at an open end of the drum key shaft. A longitudinal bore axis of the non-circular bore is preferably aligned with a centerline axis of the drum key shaft.

A torquing wing is used to rotate the wrench shaft about the centerline axis. The torquing wing is injection molded or otherwise integrally formed with the drum key shaft near a wing end portion of the drum key shaft. In one preferred embodiment according to this invention, the torquing wing diverges in a direction from an upper wing surface to a lower wing surface.

A pair of elongated arcuate prongs are integrally formed by injection molding and extend outward from a neck which extends from the upper wing surface of the torquing wing. The arcuate prongs each have an inner arcuate surface and the inner arcuate surfaces oppose each other. Prong tips of the arcuate prongs are spaced from each other, so that the arcuate prong can be forced apart as they are clipped onto a tubular structural member. For initiating and assisting such deflection, the arcuate prongs each have a prong tip formed or curved outward and away from each other. In order to prevent fracture or failure of the arcuate prongs as they are deflected outward and away from each other, stops extend from the upper wing surface of the torquing wing and each stop is positioned to contact an external prong surface of the corresponding arcuate prong to limit the maximum deflection of the arcuate prong. Also to prevent such fracture or failure, the geometrical transition between the external prong surface, the neck and the upper wing surface forms a curved surface without stress points or stress areas.

In a preferred embodiment according to this invention, the non-circular bore of the drum key shaft has a square cross section. It is apparent that other non-circular cross sections can be used as long as any such non-circular cross section is compatible with the cross section of a nut or lug head with which the drum key mates. In another preferred embodiment according to this invention, the drum key shaft has a chamfered or cupped edge inside an outer periphery of the non-circular bore.

The drum key shaft may have a knurled surface or a grooved surface near the torquing wing for increasing friction between the drum key shaft and a thumb and forefinger of a user's hand.

According to this invention, the drum key is preferably of a suitable polymeric material, such as a high-strength plastic. The drum key of this invention is preferably injection molded to reduce manufacturing costs, particularly those costs associated with labor and materials. When the drum key of this invention is injection molded, a suitable material is selected so that the drum key shaft will not fracture when torqued yet the arcuate prongs will still be able to deflect and clip to a tubular member or the like.

BRIEF DESCRIPTION OF THE DRAWINGS

The above and further objects and advantages of this invention will be apparent from the detailed description of further embodiments and by reference to the drawing wherein.

DESCRIPTION OF PREFERRED EMBODIMENTS

Drum key wrenches are used in many applications as convenient tools for rotating or torquing tension rods and various nuts. The drum key of this invention is particularly suitable for turning such tension rods or nuts associated with drums and drum equipment, primarily for acoustical tuning of the drum instruments. This invention provides a convenient way to attach the drum key to the tubular structural support members so that an inconvenience of losing or misplacing the drum key will not occur, particularly when performing with the drum set. This invention also provides a drum key that can be easily attached to and detached from the tubular structural support members, for quick access to and use of the drum key.

Figure 1:
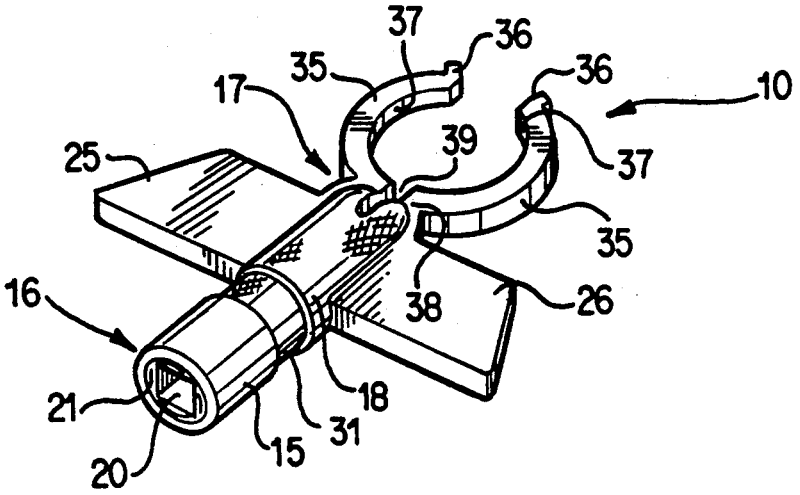
FIG. 1 shows a perspective view of a drum key according to one preferred embodiment of this invention.
Figure 3:
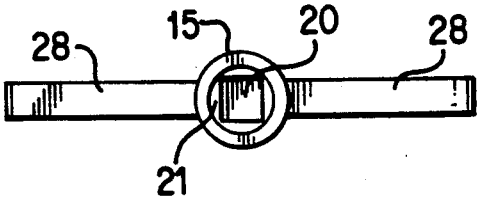
FIG. 3 shows a front view of the drum key, as shown in FIG. 2.

Referring to FIG. 1, drum key 10 is shown in perspective view, according to one embodiment of this invention. Drum key 10 comprises elongated drum key shaft 15 which has open end 16 and clip end 17. A longitudinal bore axis of non-circular bore 20 is preferably aligned with a centerline axis of drum key shaft 15. With such aligned arrangement, drum key 10 requires consistent torque forces throughout rotation of drum key shaft 15 about the longitudinal bore axis. As shown in FIG. 1, drum key shaft 15 has an overall cylindrical shape. However, it is apparent that drum key shaft 15 can have other suitable overall shapes since such physical limitation is not an important aspect of this invention.

Torque means are used to rotate drum key shaft 15 about the centerline axis. In one preferred embodiment according to this invention, the torque means comprise first wing 25 and second wing 26 each extending outward from drum key shaft 15. First wing 25 and second wing 26 extend in opposite directions with respect to drum key shaft 15. First wing 25 and second wing 26 are preferably secured to drum key shaft 15 near clip end 17, as shown in FIGS. 1-4. It is apparent that first wing 25 and second wing 26 can either be secured to exterior surface 18 of drum key shaft 15 by a press fit, a weld, by injection molding, or the like.

Figure 2:
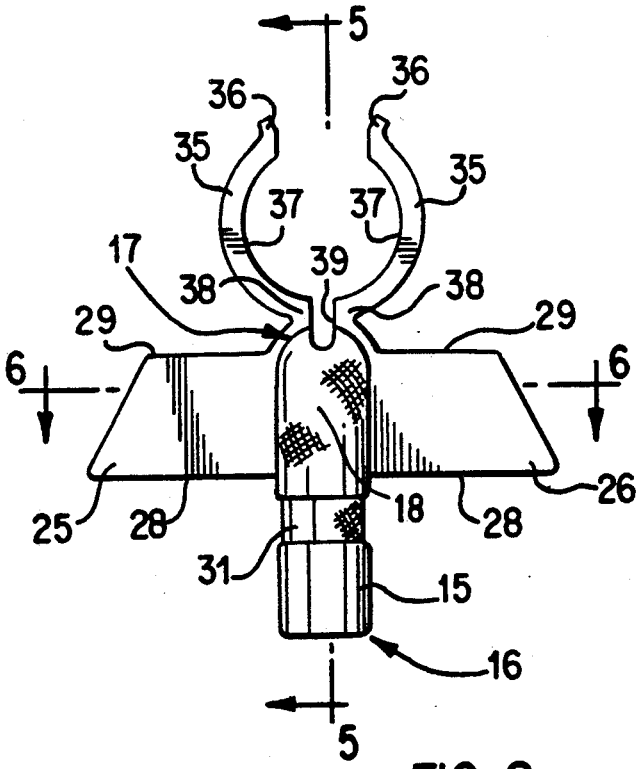
FIG. 2 shows a top view of the drum key, as shown in FIG. 1.
Figure 4:
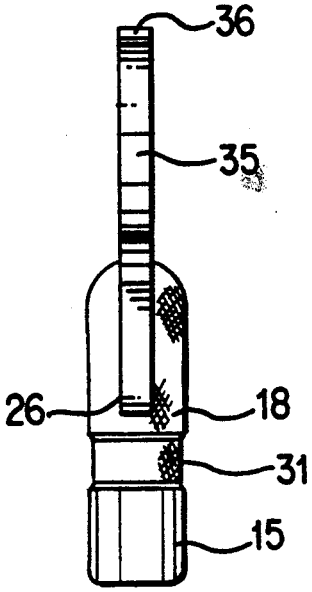
FIG. 4 shows a side view of the drum key, as shown in FIG. 2.

As clearly shown in FIG. 2, the length of base 28 of each wing is greater than the length of top 29 of each wing. Such flared or divergent arrangement allows a user to conveniently grip drum key 10 with a thumb and forefinger of the hand. It is apparent that first wing 25 and second wing 26 can have other suitable shapes, as long as each wing has sufficient length for the desired torquing.

Clip means are used to attach drum key 10 to a structural member, preferably a tubular structural member, such as a support member of a drum stand. The clip means are preferably secured to clip end 17 of drum key shaft 15, as shown in FIGS. 1, 2, 4 and 5. It is apparent that the clip means can be secured by methods similar to those for securing first wing 25 and second wing 26 to exterior surface 18.

In one preferred embodiment according to this invention, the clip means comprise a pair of elongated arcuate prongs 35 secured to and extending outward from clip end 17 of drum key shaft 15. Each arcuate prong 35 has prong tip 36. Prong tips 36 are spaced apart from each other so as to form an opening for accommodating a tubular structural member. As shown in FIGS. 1 and 2, the overall opening approximately forms a circle. It is apparent that the overall opening can have an elliptical shape so that when arcuate prongs 35 are in a deflected position, the opening is approximately circular. Each arcuate prong 35 has inner arcuate surface 37. Each inner arcuate surface 37 opposes the other inner arcuate surface 37.

Arcuate prongs 35 connect to drum key shaft 15 at base portion 38. Arcuate prongs 35 preferably form groove 39 at base portion 38, so that arcuate prongs 35 can be deflected without creating excessive stress points or stress areas. The rounded portion of groove 39, as shown in FIGS. 1 and 2, prevents such stress points or stress areas when arcuate prongs 35 are deflected away from each other. Prong tips 36 of arcuate prongs 35 are preferably formed or curved outward and away from each other. Such configuration accommodate deflection of arcuate prongs 35 when engaged with and forced against a tubular structural member. Although it is preferred that the clip means generally comprise arcuate prongs 35, as shown in FIGS. 1 and 2, it is apparent that the clip means may comprise other suitable clips which can be secured to drum key shaft 15.

Figure 7:
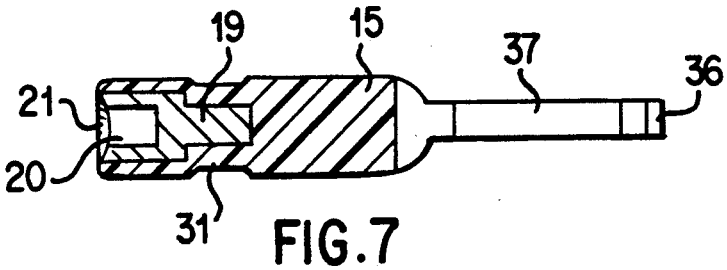
FIG. 7 shows a sectional view, similar to the view of FIG. 5, in which the drum key shaft has a metal insert.
Figure 8:
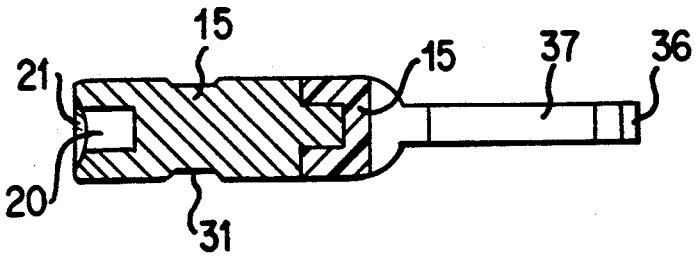
FIG. 8 shows a sectional view, also similar to the view of FIG. 5, in which the drum key shaft has a metal forward portion.

In another preferred embodiment according to this invention, as shown in FIG. 7, insert 19 is secured within a forward portion of drum key shaft 15. Such embodiment is preferred when drum key shaft 15 is of a polymeric material, such as a high-strength plastic, so that insert 19 can be constructed of metal, for providing added strength. Insert 19 can either be secured within drum key shaft 15 with a suitable adhesive, by injection molding drum key shaft 15 as a polymeric material around insert 19, or by any other suitable manufacturing method. In an embodiment which includes insert 19, non-circular bore 20 is contained within insert 19 rather than within wrench shaft 15. FIG. 8 shows one embodiment in which the entire forward portion of wrench shaft 15 is metal. It is apparent that such forward portion can be of another suitable high-strength material.

Figure 5:
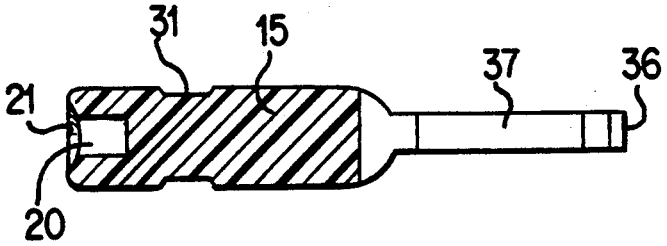
FIG. 5 shows a sectional view taken along line 5≲5, as shown in FIG. 2.
Figure 6:
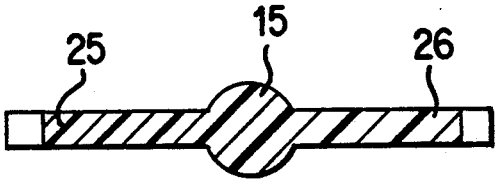
FIG. 6 shows a sectional view taken along line 6—6, as shown in FIG. 2.

In another preferred embodiment according to this invention, the inside of the outer periphery of non-circular bore 20 has chamfered or cupped edge 21, as shown in FIG. 5. Chamfered or cupped edge 21 accommodates mating between non-circular bore 20 and a corresponding tension rod or nut.

Non-circular bore 20 preferably has a square cross section since drum key 10 of this invention is particularly suitable for torquing drum tension rods. Corresponding tension rods associated with drum instruments most often have a square head or nut. However, it is apparent that non-circular bore 20 can have any other suitable cross-sectional shape, as long as it correspondingly mates with the appropriately shaped head or nut.

In another preferred embodiment according to this invention, near first wing 25 and second wing 26, exterior surface 18 has a knurled texture, as shown in FIG. 2. Exterior surface 18 can also have a grooved texture or another suitable texture which provides increased friction. Clip end 17 of drum key shaft 15 is preferably rounded, as clearly shown in FIGS. 2 and 4, but can have any other suitable shape.

As shown in FIGS. 1, 2, 4 and 5, drum key shaft 15 has indentation 31. Indentation 31 provides gripping means for removing drum key 10 from a clipped or attached position on a tubular structural member.

Drum key 10, including its various members as described above, can be constructed of any material or composite materials which provide the desired strength for torquing a tension rod or nut. Drum key 10 can be injection molded or formed with a suitable polymeric material. Insert 19 is preferably constructed with metal, but can be any other suitable material. As shown in FIG. 8, wrench shaft 15 has a clip construction of plastic and a metallic forward portion.

Although the preferred embodiments of this invention as discussed above, with respect to FIGS. 1–8, accomplishes many of the objects associated with overcoming deficiencies of prior art and other conventional drum keys or key wrenches, after experimental use with the invention as described in FIGS. 1–8, certain deficiencies were detected. When drum key 10, as shown in FIGS. 1–4, was used for its intended purpose and clipped onto a tubular structural member of drum equipment, drum key 10 of this invention performed satisfactorily. It is important to note that it became apparent that during times of non-use for its intended purpose, users of drum key 10 would fidget particularly with arcuate prongs 35. Such fidgeting included opening or deflecting arcuate prongs 35 beyond their maximum deflection limit, thereby causing fracture or failure. Even with groove 39 to prevent additional stress points or stress areas, arcuate prongs 35 did in fact fracture or crack when arcuate prongs 35 were opened to a position beyond their maximum deflection limit.

The design of the preferred embodiment of this invention as shown in FIGS. 9–13 overcomes such deficiency, due to its design. The embodiment of this invention shown in FIGS. 9–13 can be conveniently injection molded with a high-strength polymeric material or with any other suitable material. Injection molding is advantageous for drum key 110 according to the design of this invention since suitable materials can be selected that are strong enough to withstand the torquing forces applied to and within drum key shaft 115 yet flexible enough to enable adequate cantilever deflection of arcuate prongs 135.

Figure 10:
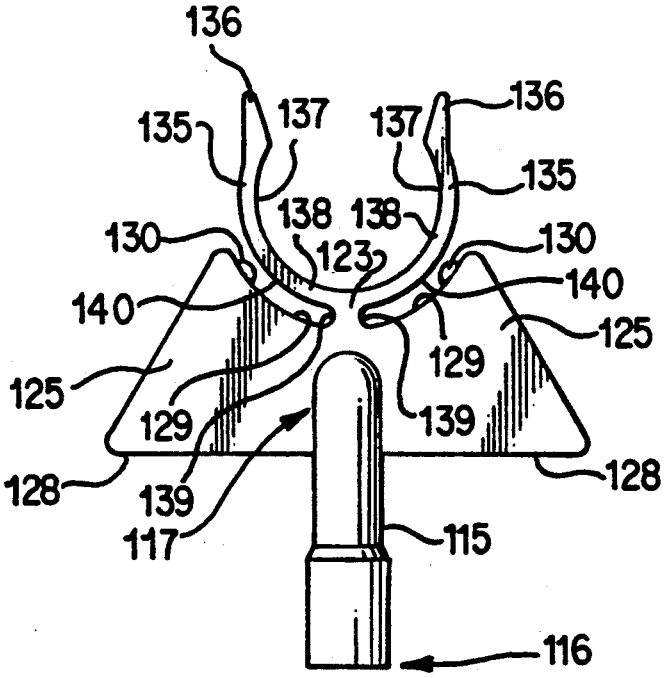
FIG. 10 shows a bottom view of the drum key, as shown in FIG. 9.

As most clearly shown in FIG. 10, the transition between external prong surface 140, neck 123 and upper wing surface 128, forms a rounded surface of groove 139, which eliminates stress points or stress areas. Also as best shown in FIG. 10, stops 130 are positioned at a predetermined and fixed distance from external prong surface 140, in order to prevent deflection of arcuate prong 135 beyond its maximum deflection limit. Thus, the design of such preferred embodiment according to this invention overcomes the main deficiency associated with the embodiment as shown in FIGS. 1–8. Furthermore, with such design, drum key 110 can be successfully injection molded.

Referring in more detail to the preferred embodiments shown in FIGS. 9–13, drum key 110 comprises drum key shaft 115, torquing wing 125, a pair of stops 130, neck 123, and a pair of elongated arcuate prongs 135. Such components of drum key 110 are preferably integrally formed by injection molding them into one piece. The injection molded piece significantly reduces the overall manufacturing cost, including labor costs and material costs, of producing relatively large quantities of drum key 110. Drum key shaft 115 has open end 116 and wing end portion 117, which is opposite of open end 116. Open end 116 has non-circular bore 120. Non-circular bore 120 preferably has a square cross section. However, it is apparent that non-circular bore 120 can have any other suitable non-circular cross section which prevents drum key shaft 115 from rotating with respect to the tension rod or nut.

Figure 9:
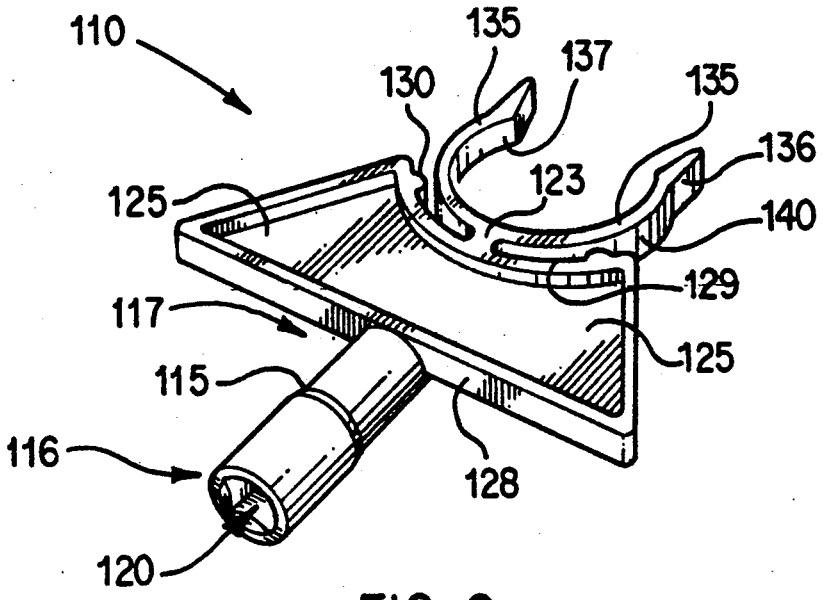
FIG. 9 shows a perspective top view of a drum key according to another preferred embodiment of this invention.
Figure 11:
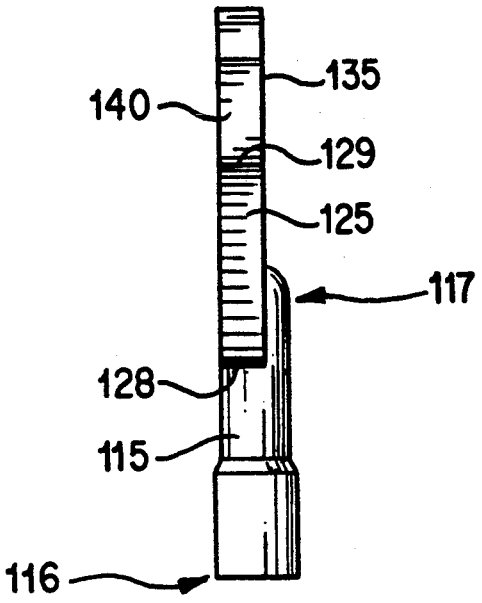
FIG. 11 shows a side view of the drum key, as shown in FIG. 10.
Figure 12:
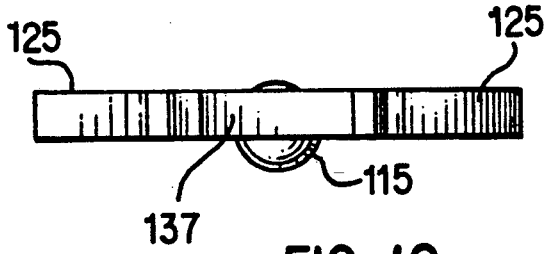
FIG. 12 shows a rear view of the drum key, as shown in FIG. 10.
Figure 13:
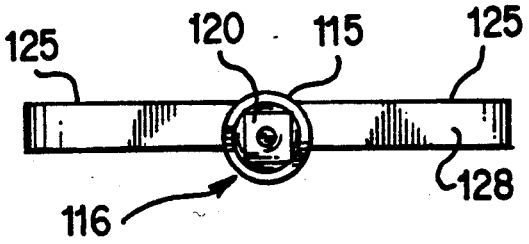
FIG. 13 shows a front view of the drum key, as shown in FIG. 10.

Torquing wing 125 is integrally formed with wing end portion 117. FIGS. 10 and 11 show one preferred embodiment of how torquing wing 125 is integrally formed with wing end portion 117. As shown in FIGS. 9 and 10, neck 123 is integrally formed with torquing wing 125. As clearly shown in FIG. 10, neck 123 extends outward from upper wing surface 129.

Arcuate prongs 135 are integrally formed with and extend outward from neck 123, as clearly shown in FIGS. 9 and 10. Each arcuate prong 135 has a free end and an opposite fixed end. The fixed end is essentially the integral connection between base portion 138 of arcuate prong 135 and the upper portion of neck 123. Thus, each arcuate prong 135 acts as a cantilever wherein the free end deflects when a force is applied to it. The free ends are spaced apart from each other so that they can be spread apart from each other when clipping drum key 110 to a tubular structural member, such as a drum stand or other drum support members. In one preferred embodiment according to this invention, prong tips 136 are injection molded outward and away from each other, as clearly shown in FIG. 10, for accommodating any tubular structural member.

Stops 130 are a very important aspect of this invention. As shown in FIGS. 9 and 10, stops 130 are integrally formed with torquing wing 125. Each stop 130 extends outward from upper wing surface 129 toward a corresponding arcuate prong 135. Each stop 130 limits the outward deflection of such corresponding arcuate prong 135. Thus, arcuate prong 35 is prevented from deflecting beyond maximum deflection limit or its tolerable limit. It is apparent that stops 130 can have other geometrical arrangements and still accomplish the same result of limiting the outward deflection of arcuate prongs 135. As best shown in FIG. 9, each stop 130 is shaped as an approximately semi-cylindrical extension which extends across at least a portion of a width of upper wing surface 129.

As most clearly shown in FIG. 10 and according to one preferred embodiment of this invention upper wing surface 129 is curved and follows the contour of external prong surface 140. Such shape accommodates injection molding and provides a fixed distance between upper wing surface 129 and external prong surface 140. Such shape also enables groove 139 to be formed within neck 123. The smooth curve of groove 139 prevents stress points or stress areas and thus enables more successful deflection of arcuate prongs 135.

As shown in FIGS. 9–11, drum key shaft 115 is preferably elongated. Such elongated configuration allows access to the drum tension rod or nut that will be torqued. Torquing wing 125 is preferably positioned with respect to drum key shaft 115 so as to allow drum key 110 to rotate about a centerline axis of drum key shaft 115. In one preferred embodiment according to this invention, torquing wing 125 diverges in a direction from upper wing surface 129 to lower wing surface 128, which is opposite of upper wing surface 129. Such diverging shape accommodates a user's thumb and forefinger when gripping drum key 110.

It is apparent that many of the components of this invention can be interchanged between the embodiments shown in FIGS. 1–8 and the embodiments shown in FIGS. 9–13. Although the discussion with respect to FIGS. 9–13 may not mention each and every component discussed with respect to FIGS. 1–8, it is not intended in any way limit either set of embodiments by not discussing each and every interchangeable component.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A drum key for torquing tension rods or nuts of drum equipment, the drum key comprising:

a drum key shaft, a torquing wing, a pair of stops, a neck, and a pair of elongated arcuate prongs of the drum key being formed in one injection molded piece;

said drum key shaft having an open end and a wing end portion opposite of said open end, said open end having a bore with a non-circular cross section for engaging and rotating a fastener;

said torquing wing integrally formed with said wing end portion, said torquing wing having an upper wing surface, said neck integrally formed with said torquing wing, said neck extending outward from said upper wing surface;

said elongated arcuate prongs integrally formed with and extending outward from said neck, each said arcuate prong having a free end, said free ends spaced apart from each other, each said arcuate prong having an inner arcuate surface, said inner arcuate surfaces facing each other for grasping a tubular member;

said stops integrally formed with said torquing wing, each said stop extending from said upper wing surface toward a corresponding said arcuate prong, each said stop limiting outward deflection of each corresponding said arcuate prong; and wherein said upper wing surface follows a contour of an external prong surface of each said arcuate prong for providing support to each said external prong surface during outward deflection of said arcuate prongs.

2. A drum key according to claim 1 wherein said upper wing surface is curved.

3. A drum key according to claim 2 wherein a fixed distance is maintained between said upper wing surface and said external prong surface.

4. A drum key according to claim 1 wherein said drum key shaft is elongated.

5. A drum key according to claim 1 wherein a geometrical transition between an external prong surface of each said arcuate prong, said neck and said upper wing surface consists of a curved surface.

6. A drum key according to claim 1 wherein each said stop further comprises an approximately semi-cylindrical extension extending across at least a portion of a width of said upper wing surface.

7. A drum key according to claim 1 wherein said non-circular cross section is square.

8. A drum key according the claim 1 wherein said torquing wing is approximately centered about a centerline axis of said drum key shaft.

9. A drum key according to claim 1 wherein said torquing wing diverges in a direction from said upper wing surface to an opposite lower wing surface of said torquing wing.

10. A drum key according to claim 1 wherein each said free end comprises a prong tip and said prong tips are injection molded outward away from each other.

11. A drum key according to claim 1 further comprising said drum key shaft having a cupped edge positioned inside of an outer periphery of said non-circular cross section of said bore.

12. A drum key according the claim 1 wherein the injection molded drum key is of a polymeric material.

* * * * *